US012410980B1

(12) United States Patent
Guerra

(10) Patent No.: US 12,410,980 B1
(45) Date of Patent: Sep. 9, 2025

(54) DROP-IN SYSTEM TO ENHANCE THE RESETTING AND OPERATIONS OF SEMIAUTOMATIC FIREARMS

(71) Applicant: Trigger Empire, Inc., Mount Pleasant, TX (US)

(72) Inventor: Jesus Guerra, Mount Pleasant, TX (US)

(73) Assignee: Trigger Empire, Inc., Mount Pleasant, TX (US)

( * ) Notice: Subject to any disclaimer, the term of this patent is extended or adjusted under 35 U.S.C. 154(b) by 0 days.

(21) Appl. No.: 18/927,257

(22) Filed: Oct. 25, 2024

(51) Int. Cl.
*F41A 19/15* (2006.01)
*F41A 17/48* (2006.01)

(52) U.S. Cl.
CPC ..... *F41A 19/15* (2013.01); *F41A 17/48* (2013.01)

(58) Field of Classification Search
CPC ..... F41A 19/15; F41A 19/42; F41A 19/44; F41A 17/48; F41A 11/00
See application file for complete search history.

(56) References Cited

U.S. PATENT DOCUMENTS

2021/0080212 A1* 3/2021 Alber ..... F41A 19/14
2022/0290939 A1* 9/2022 Lee ..... F41A 19/15
2023/0003476 A1* 1/2023 Markut ..... F41A 11/02
2024/0410666 A1* 12/2024 Lee ..... F41A 19/31

* cited by examiner

*Primary Examiner* — J. Woodrow Eldred
(74) *Attorney, Agent, or Firm* — Stephen Y. Liu; Carstens, Allen & Gourley, LLP

(57) ABSTRACT

A drop-in system for a semiautomatic firearm trigger includes a trigger-locking block, a hump block, a trigger-locking block transfer bar and an axis retainer plate that operate together to enhance the operations of a semiautomatic firearm trigger. The trigger-locking block is pivoted on a firearm safety pin to lock the trigger when the carrier bolt travels rearward, the hump block is pivotally disposed within a trigger cradle on a trigger pin to receive a force of a hammer to rotate rearward to rotate the trigger assembly backward, the trigger-locking block transfer bar slides along carrier bolt guide and rotate the trigger-locking block forward to releasee the trigger, and the axis retainer plate holds the trigger-locking block rotatably in place and limits the rotation of the trigger-locking block.

6 Claims, 8 Drawing Sheets

DROP-IN SYSTEM TO ENHANCE THE RESETTING AND OPERATIONS OF SEMIAUTOMATIC FIREARMS

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71 (d).

BACKGROUND OF THE INVENTIVE CONCEPT

1. Field of the Invention

The present inventive concept relates to a drop-in system for semiautomatic firearms, and more particularly, to a drop-in system to enhance the resetting and operations of a trigger for semiautomatic firearms.

2. Description of the Related Art

A standard semiautomatic firearm generally includes a trigger, a trigger-locking bar, a hammer, a bolt carrier with a bolt, and a disconnect. FIGS. 1A-1C illustrate basic operations of the standard semiautomatic firearm.

Referring to FIG. 1A, the trigger includes a trigger-locking bar, which holds a hammer in a cocked position until a trigger is pulled. As illustrated in FIG. 1A, the trigger is at a reset position where the trigger is holding the hammer back in a cocked position ready to be released in a forward direction to fire the semiautomatic firearm. If the well-known firearm safety switch (not illustrated) is in an active position the trigger will be prevented from being pulled to release the hammer, and if the firearm safety is in a non-active position the trigger will be enabled to be pulled.

FIG. 1B illustrates the stage where the firing cycle of the semiautomatic firearm is at a halfway point with the trigger in a pulled position. At this stage the semiautomatic firearm is in a state where the hammer is being released from the trigger locking bar to fire the firearm.

FIG. 1C illustrates a state in which the trigger is still in the depressed position and the disconnect catches the hammer on the way back after the semiautomatic firearm has been fired. The main job of the disconnect is to hold down the hammer to prevent the hammer from following the bolt carrier forward when the bolt carrier is moving back to its forward position after driving the hammer back. As a result of a spring action the bolt carrier is forced back after the semiautomatic is fired. The disconnect is provided to catch the hammer when the hammer is pushed back by the bolt carrier since the trigger may still be in the pulled. This is important since if the hammer follows that bolt carrier forward while the bolt carrier is traveling forward and the trigger is still in the pulled position the hammer, although traveling forward, will not have enough kinetic energy to set off the primer when sticking a firing pin (not illustrated), which sets off the cartridge in the barrel. When the pressure being applied to the trigger is released the disconnect will also follow the travel movement of the trigger, and the trigger will catch the hammer to "reset" the firearm while the disconnect releases its hold on the hammer. This action of the trigger catching the hammer results in the semiautomatic firearm returning back to the position as illustrated in FIG. 1A.

SUMMARY OF THE PRESENT INVENTIVE CONCEPT

The present general inventive concept. More particularly, but not exclusively, the present inventive concept a drop-in system for semiautomatic firearms, and more particularly, to a drop-in system for semiautomatic firearms to enhance the resetting and operations of a trigger for semiautomatic firearms.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a drop-in system for a semiautomatic firearm that includes a trigger assembly pivotal about a trigger axis pin, a bolt carrier that slides back and forth along a receiver of the semiautomatic firearm, a spring-loaded hammer that rotates about a hammer axis pin, a firearm safety including a corresponding safety axis pin extending therefrom, and a bolt carrier guide that extends along an interior of the receiver to guide the bolt carrier back and forth, the drop-in system comprising: an elongated axis retainer plate having one end configured to be fixed to the hammer axis pin and a second end configured to be fixed to the safety axis pin; a trigger-locking block configured to pivot about the firearm safety axis pin, the trigger-locking block including a limit protrusion extending from a lower end thereof to contact the elongated axis retainer plate to limit rearward pivotal movement of the trigger-locking block; a hump block configured to pivot about the trigger pin independently of pivotal movement of the trigger assembly; and a trigger-locking block transfer bar configured to slide along the bolt carrier guide and including a limit protrusion extending from a rear bottom portion thereof.

In an example embodiment, when the bolt carrier travels in a rearward direction along the receiver due to firing of the semiautomatic firearm: the bolt carrier collides with the hammer; the hammer rotates rearward and collides with the hump block; the hump block pivots rearward and collides with the trigger assembly to rotate the trigger assembly rearward; and the bolt carrier collides with the trigger-locking block to rotate the trigger-locking block rearward to lock a rear end of the trigger assembly.

In another example embodiment, after the bolt carrier completes the travel rearward the bolt carrier springs in a forward direction to collide with the limit protrusion of the trigger-locking block transfer bar to slide the trigger-locking bar in a forward direction such that the limit protrusion collides with a top portion of the trigger-locking block to pivot the trigger-locking block in a forward direction to release the rear end of the trigger assembly from the locked position.

In another example embodiment, the elongated axis retainer plate comprises: a notch formed at a first end thereof to connect with the hammer axis pin; a hole extending through a second opposite end thereof to receive the safety axis pin therethrough; and a bend formed at a middle portion thereof to extend inward and apply a friction to a side of the trigger-locking block and to stop the limit protrusion to limit the rearward rotation of the trigger-locking block. In still another example embodiment, the elongated axis retainer plate is disposed in the receiver by the notch formed at the first end thereof being fixed over the hammer axis pin and the safety axis pin being slid through a first hole extending through a first side of the receiver, through a hole extending through the trigger-locking block, through the hole extending through the second end of the elongated axis retainer plate, and an end of the safety axis pin being snapped into a second hole extending through a second side of the receiver.

The foregoing and/or other features and utilities of the present general inventive concept may also be achieved by providing a drop-in system for a semiautomatic firearm configured to be placed within a receiver of the semiautomatic firearm, comprising: an axis retainer plate configured to be disposed between a hammer axis pin and safety axis pin; a hump block configured to pivot about a trigger axis pin of a trigger to pivot the trigger backward; a trigger-locking block configured to pivot about the safety axis pin in a first direction until making contact with the elongated axis retainer plate and locking the trigger from being pulled; and a trigger-locking block transfer bar configured to slide along an inner wall of the receiver and including a limit protrusion extending from a rear bottom portion thereof to pivot the trigger-locking block in a second direction to unlock the trigger.

Additional features and utilities of the present general inventive concept will be set forth in part in the description which follows and, in part, will be obvious from the description, or may be learned by practice of the general inventive concept.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1A:
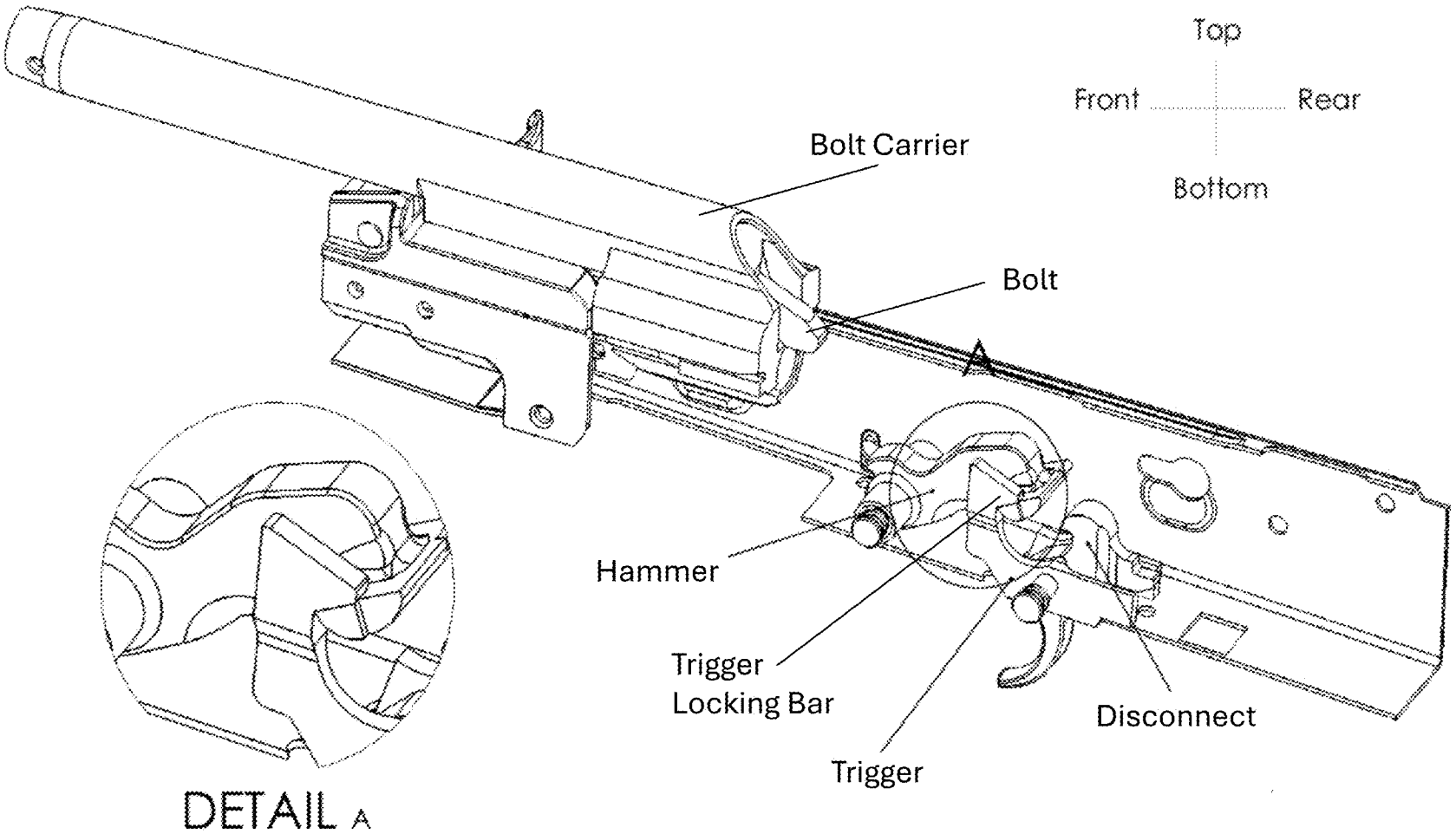
FIG. 1A (PRIOR ART)
FIGS. 1A-1C illustrate various steps of a semiautomatic firearm according to conventional operations.
Figure 1B:
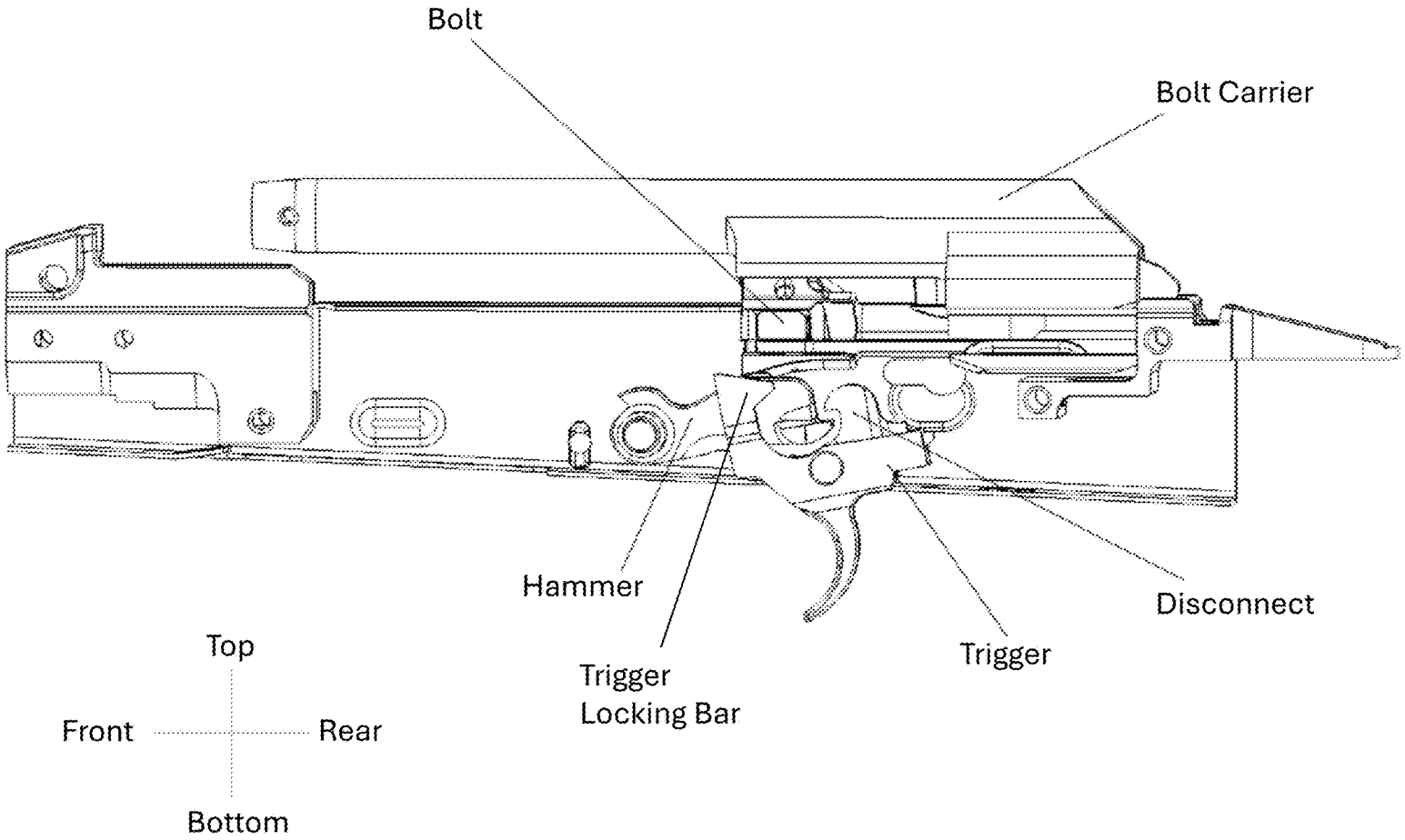
FIG. 1B (PRIOR ART)
Figure 1C:
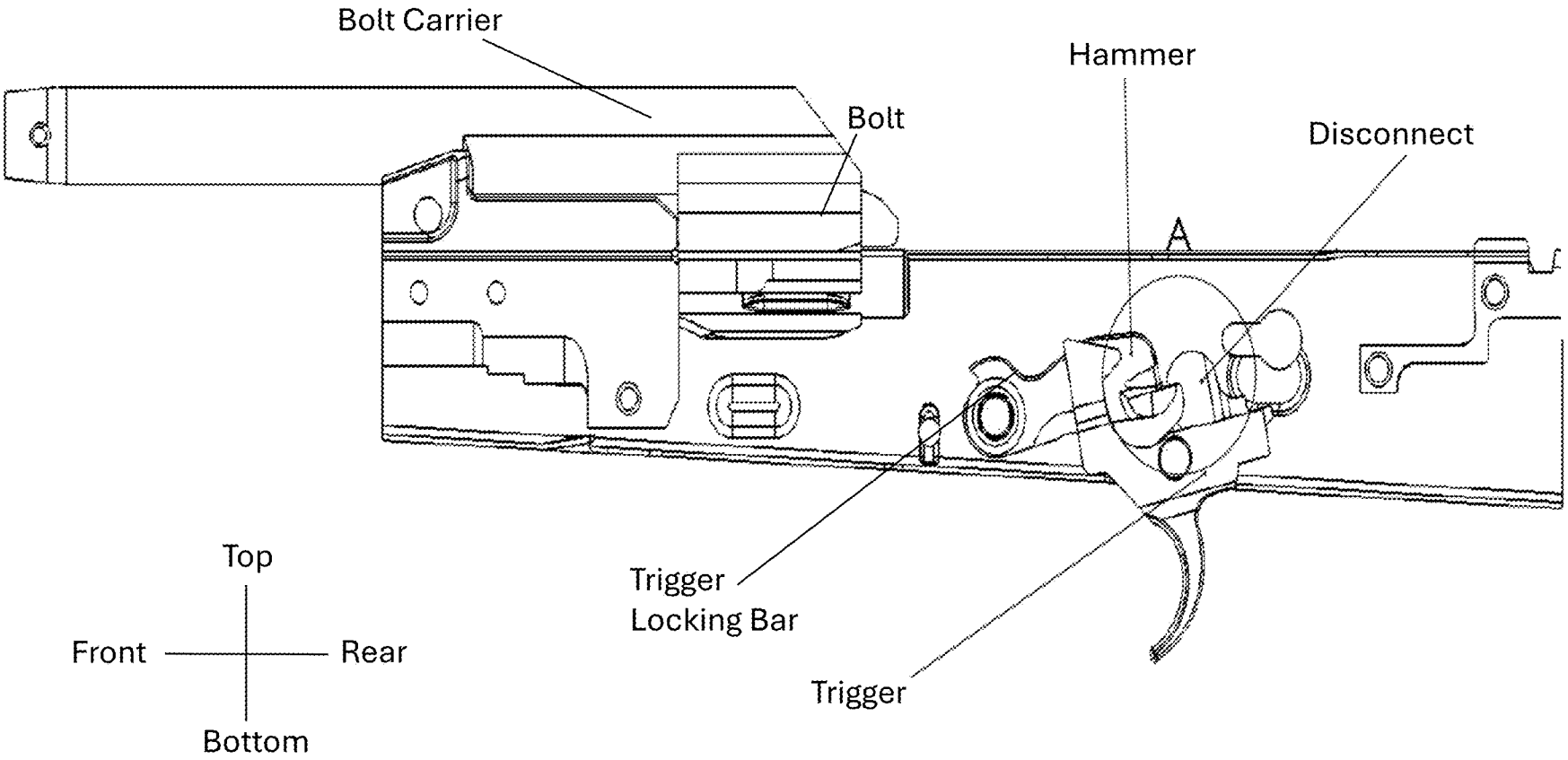
FIG. 1C (PRIOR ART)

The drawing illustrates a process for making the invention according to an example embodiment of the present inventive concept and is not to be considered limiting in its scope, as the overall inventive concept may admit to other equally effective embodiments.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to the intention of the lexicographer, case precedents, or the appearance of new technologies. Also, some terms may be arbitrarily selected by the inventors, and in this case, the meaning of the selected terms will be described in detail in the detailed description herein. Thus, the terms used herein should be defined based on the generally defined meaning of the terms together with the description throughout this specification.

Hereinafter, one or more exemplary embodiments of the present general inventive concept will be described in detail with reference to accompanying drawings.

Example embodiments of the present general inventive concept are directed to a drop-in system for a firearms trigger which improves the resetting of the trigger upon firing a cartridge in a chamber of the firearm.

Figure 2:
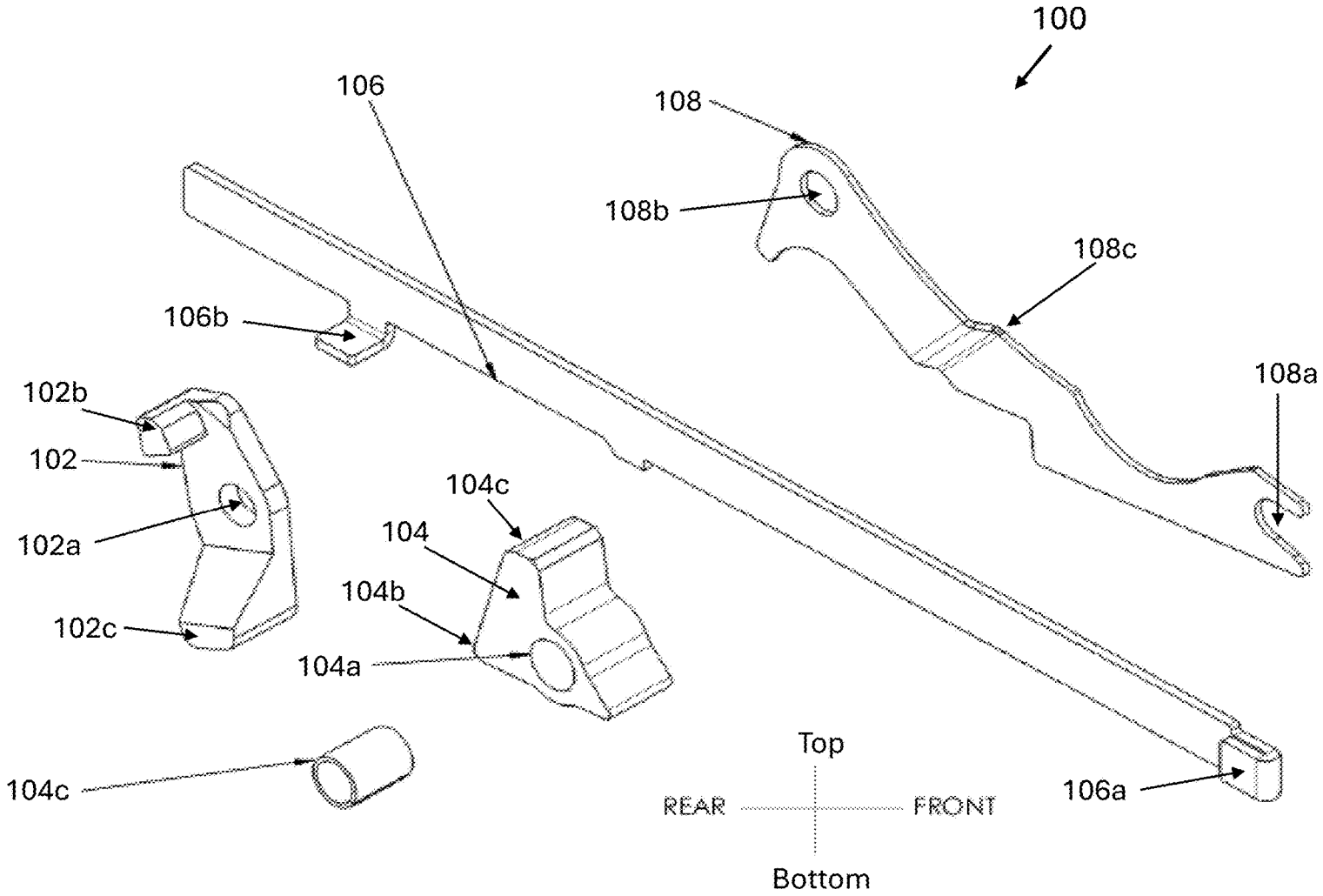
FIG. 2 illustrates an exploded perspective view of a drop-in system for a firearms trigger, according to an example embodiment of the present inventive concept.

FIG. 2 illustrates an exploded perspective view of a drop-in system 100 for enhancement of a firearms trigger, according to an example embodiment of the present inventive concept. As illustrated in FIG. 2, the drop-in system 100 for enhancement of a firearms trigger according to this example embodiment can include a trigger-locking block 102, a hump block 104, a trigger-locking block transfer bar 106 and an axis retainer plate 108. Depending on the size of a trigger axis pin 124*cl* (see FIG. 3) that holds the trigger in a rotational position, the drop-in system 100 can also include a shortened adaptor sleeve 104*c* to assist in a secure fitting of the hump block 104 onto the trigger axis pin 124*cl* via a hump block hole 104*a* extending therethrough. Positioning of the drop-in system 100 and each of the parts thereof into a receiver of a semiautomatic firearm are described below with respect to FIGS. 3-6, as well as operations of each of the parts of the drop-in system 100 within a semiautomatic firearm receiver 118.

Figure 3:
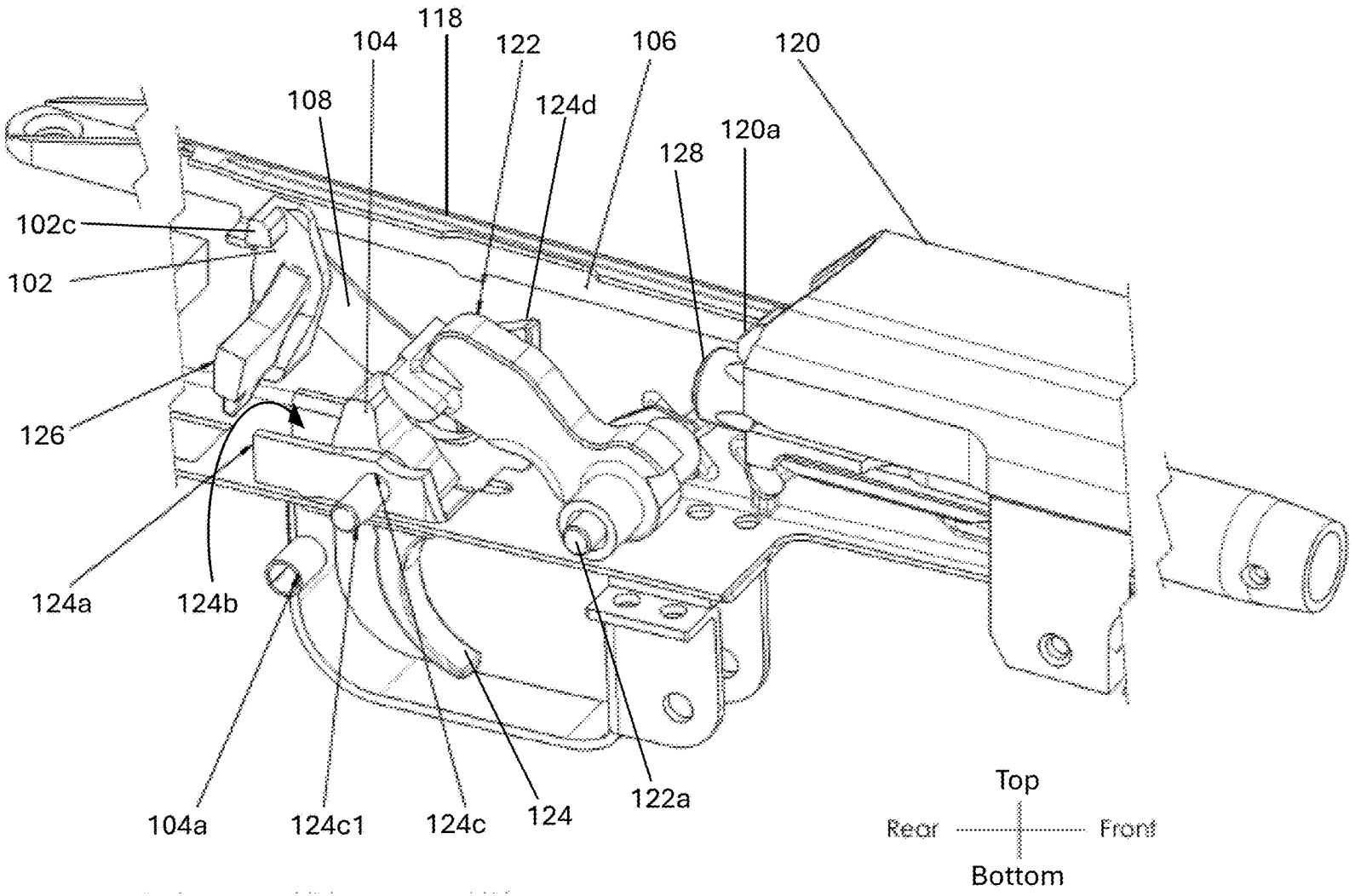
FIG. 3 illustrates an operational perspective view of the drop-in system for a firearms trigger, according to the example embodiment illustrated in FIG. 2.

FIG. 3 illustrates an operational plan view of the drop-in system 100 for a semiautomatic firearm, according to the example embodiment illustrated in FIG. 2. The standard trigger 124 for a semiautomatic firearm generally includes a rear section 124*a*, a cradle section 124*b*, a hole 124*c* extending through the sides of the cradle section 124*b*, a trigger axis pin 124*cl* to hold the trigger 124 in place while being pivotal about the trigger pin 124*c*1, and a hammer engagement hook 124*d* (see also FIG. 4) disposed within a semiautomatic firearms receiver 118. The hump block 104 according to the present example embodiment can be placed into the cradle 124*b* of the trigger 124 and can include a bottom portion 104*b* and a top portion 104*c*, as well as the hole 104*a* to receive the trigger axis pin 124*cl* therethrough. Each of the sides of the cradle section 124*b* include a trigger pin reception hole 124*c* to receive the trigger axis pin 124*cl* therethrough to enable pivotal movement back and forth of the trigger 124 while keeping the trigger 124 in place. The trigger axis pin 124*cl* can also be inserted through the hole 104*a* (see FIG. 2) formed through the hump block 104 to retain the hump block 104 within the trigger cradle 124*b*, and also to enable the hump block 104 to be pivotal about the trigger axis pin 124*c*1. In this configuration the hump block 104 can rock back and forth (i.e., pivot) about the trigger axis pin 124*c*1. In the case where the diameter of the trigger axis pin 124*cl* is smaller than the diameter of the hole extending through the hump block 104 a shortened pin adaptor sleeve 104*c* can be inserted within the hole 104*a* through the hump block 104. The pin adaptor sleeve 104*c* is configured to tightly fit within the hole 104*a* formed through the hump block 104 and to have an inner diameter slightly larger than the diameter of the trigger axis pin 124*cl* to enable the hump block 104 to freely rock back and forth (i.e., pivot) on the trigger axis pin 124*c*1.

The trigger-locking block 102 is configured to be pivotally fixed in place by a well-known firearm safety device 126, which is included with all or most semiautomatic firearms in order to disable and enable a user to fire the semiautomatic firearm by blocking and unblocking the user's ability to pull the trigger 124. More specifically, the firearm safety device 126 generally includes a safety device axis pin 126*a* that extends from a side thereof that is inserted through a first hole extending through one side of the semiautomatic firearms receiver 118, through a hole extending through a retainer plate (not illustrated), and then snaps into a second hole extending through a second opposite side of the semiautomatic firearms receiver 118. The safety device 126 is commonly provided as a pivot switch that will pivot the safety device 126 back and forth to either be positioned away from the rear end 124*a* of the trigger 124 or directly over the rear end 124*a* of the trigger 124.

According to an example embodiment, the standard retainer plate can be first replaced with the specifically configured axis retainer plate 108 according to an example embodiment of the present inventive concept, as illustrated in FIG. 2. The axis retainer plate 108 can be used to replace the standard retainer plate by removing the standard retainer plate and placing the axis retainer plate 108 within the semiautomatic firearm receiver 118. More specifically the axis retainer plate 108 is configured to have a notch 108*a* formed into a first end thereof such that the notch 108*a* is inserted over a hammer axis pin 122*a* in which a hammer 122 of a semiautomatic firearm rotates about. The axis retainer plate 108 also includes a hole 108*b* extending through an opposite end thereof. The end of the safety device axis pin 126*a* (opposite the side in which the safety device is connected) can be extended through the hole 108*b* in the axis retainer plate 108 after the safety device axis pin 126*a* is inserted through the first hole in the semiautomatic receiver and through a hole 102*a* extending through the trigger-locking block 102. The end of the safety device axis pin 126*a* can then be snapped into the second hole extending through a second opposite side of the semiautomatic firearms receiver 118. The axis retainer plate 108 also includes a bend 108*c* disposed at approximately a middle section thereof to provide a spring action, as described in more detail below.

Figure 4:
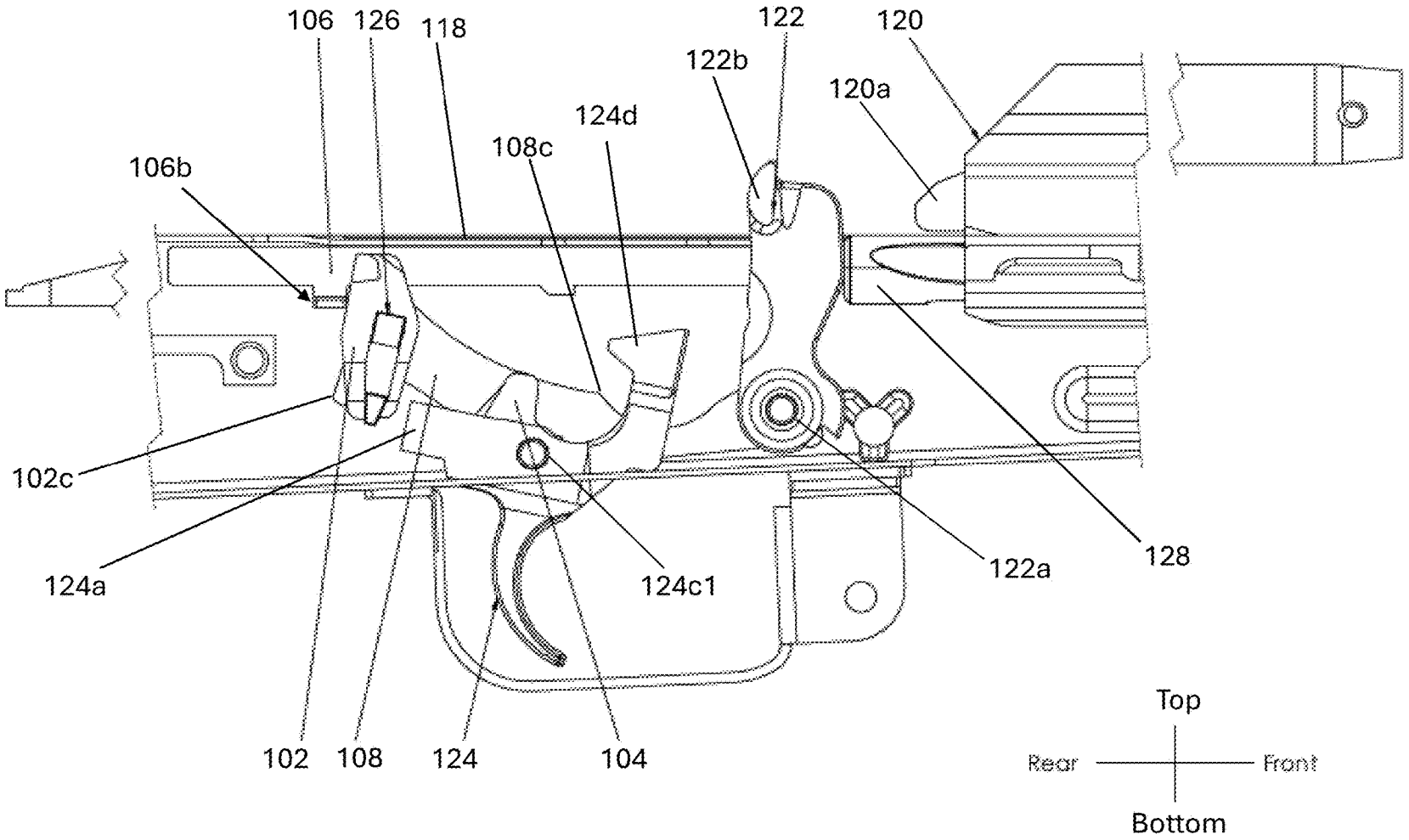
FIG. 4 illustrates an operational side view of the drop-in system for a firearms trigger, according to the example embodiment illustrated in FIG. 2.
Figure 5:
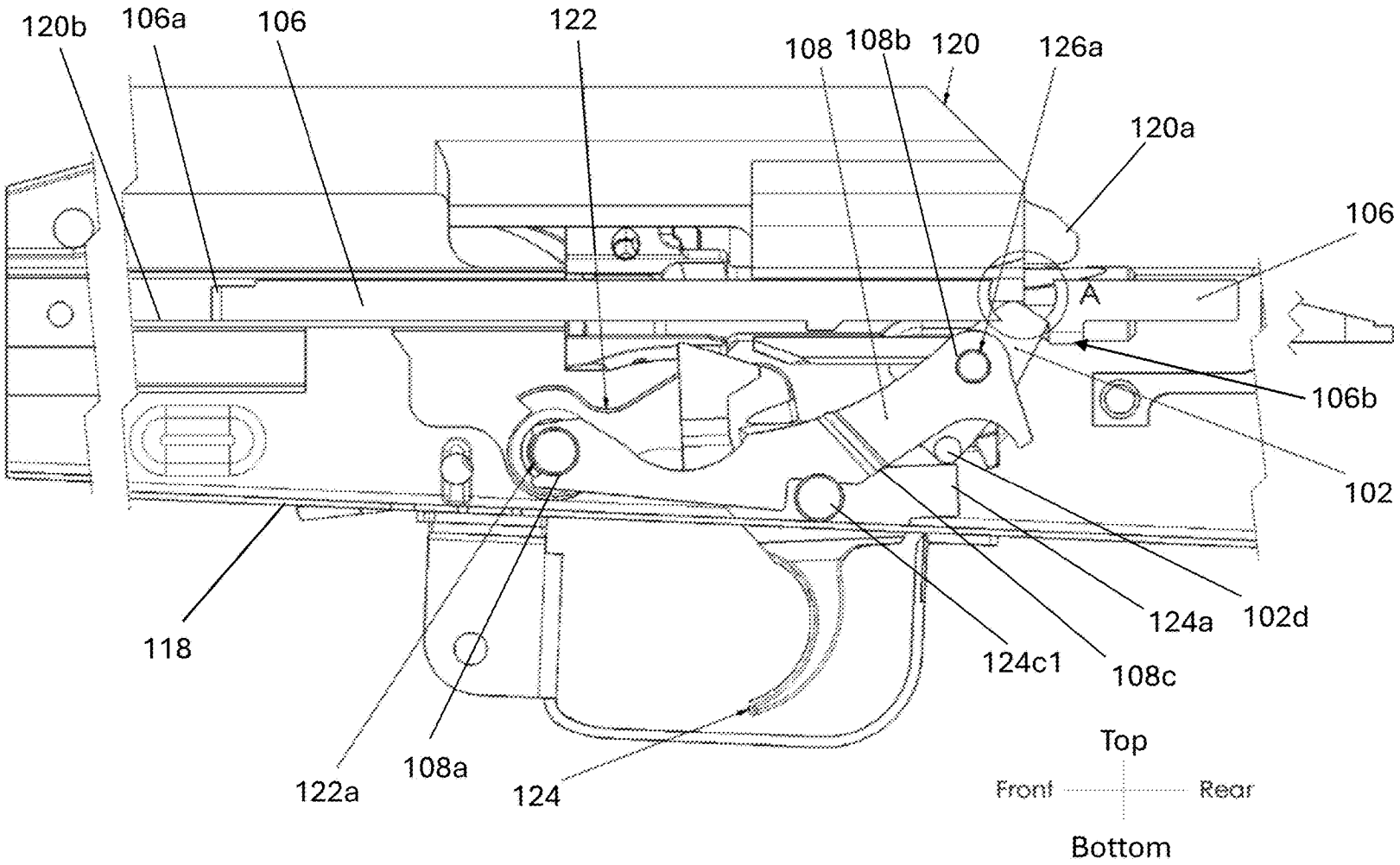
FIG. 5 illustrates another elevated operational side view of the drop-in system for a firearms trigger, according to the example embodiment illustrated in FIG. 2.

FIG. 4 illustrates an elevated operational side view of the drop-in system 100 for a firearms trigger, according to the example embodiment illustrated in FIG. 2. FIG. 5 illustrates another elevated operational side view of the drop-in system for a firearms trigger, according to the example embodiment illustrated in FIG. 2.

Referring to FIGS. 2-4, a second end of the axis retainer plate 108 is configured to have a hole 108*b* extending therethrough to fixedly receive the safety device axis pin 126*a* which extends from a side of the firearm safety 126. The trigger-locking block 102 is configured to have a hole 102*a* extending therethrough in which the safety device axis pin 126*a* will extend through such that the trigger-locking block 102 will rotate about the safety device axis pin 126*a* of the firearm safety 126. The trigger-locking block 102 can be configured to include an upper notch 102*b* and a lower notch 102*c*, which is described in more detail below. The trigger-locking block 102 is also configured to include a trigger-locking block limit protrusion (or cylinder) 102*d* (see FIG. 5), which is also described in more detail below with reference to FIG. 5. The trigger-locking block 102 can rotate back and forth on the safety device axis pin 126*a* within a certain range of rotational motion due to the trigger-locking block limit protrusion 102*d*, as well as friction applied to the side of the trigger-locking block 102 by the bend 108*c* formed in the axis retainer plate 108, as is described in more detail below.

Generally, a semiautomatic firearm includes a bolt carrier 120 and a bolt 120*a*. Along the internal side of the semiautomatic firearm there is a bolt carrier guide 120*b*. The trigger-locking block transfer bar 106 is configured to be inserted into the semiautomatic firearm such that the trigger-locking block transfer bar 106 rests on and slides along the bolt carrier guide 120*b* (see FIG. 5). The trigger-locking block transfer bar 106 is configured to have a folded portion 106*a* at a first end thereof and a tongue 106*b* extending away from a side thereof close to a second end of the trigger-locking block transfer bar 106.

Once the trigger-locking block 102, the hump block 104, the trigger-locking block transfer bar 106 and the axis retainer plate 108 are placed within the receiver of the semiautomatic firearm the process of firing and reloading the semiautomatic firearm acts as follows. When the semiautomatic firearm is placed in a cocked position a hammer lip 122*b* (see FIG. 4) will become engaged by the hammer engagement hook 124*d* of the trigger 124, thus preventing the hammer 122 from springing forward and hitting a firing pin (not illustrated for brevity of the detailed description). The firing pin hits the back of a round (cartridge) disposed in the chamber 128 and fires the round when the hammer 122 strikes the firing pin. When the trigger 124 is pulled the hammer 122 will become released from the hammer engagement hook 124*d* and spring forward to strike the firing pin. This action will begin the cycling process described below.

The cycling process of a semiautomatic firearm with the drop-in system 100 for a semiautomatic firearms trigger, according to the present inventive concept, begins with the bolt carrier 120 traveling rearward as a result of the force of gas traveling through a gas tube to a piston at the front of the semiautomatic firearm. The gas traveling through the gas tube will reach the piston, which in turn will move the bolt carrier 120 backwards. As the bolt carrier travels backwards it will collide with the hammer 122. The hammer 122 will then be forced to pivot rearward and collide with the top portion 104*c* of the hump block 104. As described above, the hump block 104 is pivotally fixed within the trigger cradle 124*b* on the trigger axis pin 124*cl*. Also as pointed out above, the hump block 104 can either be pivotally fixed directly on the trigger axis pin 124*cl* or pivotally fixed on the trigger axis pin 124*cl* with the aid of the axis adaptor sleeve 104*c*, which is designed to take up space within the hole 104*a* of the hump block 104. The trigger assembly 124 will also be forced to pivot rearward by the hammer 122 colliding against the hump block 104, since the hump block 104 will pivot back and the bottom section 104*b* of the hump block 104 will push the rear end 124*a* of the trigger down. At this point a hammer lip 122*b* extending from the hammer 122 will become engaged by the hammer engagement hook 124*d* on the trigger 124. The hammer engagement hook 124*d* will engage with the hammer lip 122*b* and hold the hammer 122 from springing forward. The bolt carrier 120 will continue to travel rearward and the bolt 120*a* on the bolt carrier 120 will collide with the upper notch 102*b* of the trigger-locking block 102. The trigger-locking block 102 will then pivot rearward on the safety axis pin 126*a*, which extends between the firearm safety 126 and the axis retainer plate 108. The trigger-locking block 102 will pivot rearward with friction applied to one side of the trigger-locking block 102 from the inward bend 108*c* of the axis retainer plate 108 making contact with the trigger-locking block 102 until the trigger-locking block limit protrusion 102*d* hits a bottom of the axis retainer plate 108 at a location where the bend 108*c* extends inward (see FIG. 5). Thus, the trigger-locking block 102 will pivot counterclockwise (with reference to FIGS. 3 and 4) until the lower notch 102*c* of the trigger-locking block 102 collides with the rear end 124*a* of the trigger 124 and will push the rear end 124*a* of the trigger 124 down to lock the trigger 124 in place. As pointed out above, the axis retainer plate 108 will limit the pivotal movement of the trigger-locking block 102 as a result of the trigger-locking block limit protrusion 102*d* hitting the bottom of the axis retainer plate 108 at a location where the bend 108*c* extends inward to catch the trigger-locking block limit protrusion 102*d* (see FIG. 5).

Once the bolt carrier 120 completes its travel rearward it will begin to travel in the forward direction (the "front" direction of the semiautomatic firearm) as a result of a spring action force applied by a well-known coil spring (not illustrated to provide brevity to the detailed description). As the bolt carrier 120 continues to travel forward a shoulder of the carrier bolt 120 will collide with the folded end 106*a* of the trigger-locking block transfer bar 106. The trigger-locking block transfer bar 106 will then be forced to slide forward along the carrier bolt guide 120*b* formed along an inner side of the semiautomatic firearm receiver 118. As a result of the forward sliding movement of the trigger-locking block transfer bar 106 the tongue 106*b* of the trigger-locking block transfer bar 106 will collide with the upper notch 102*b* of the trigger-locking block 102 and cause the trigger-locking block 102 to pivot clockwise (with reference to FIGS. 3 and 4), thus unlocking the trigger 124 (the lower notch 102*c* of the trigger-locking block 102 will rotate away from the rear end 124*a* of the trigger 124) from the trigger-locking block 102. At this point the trigger 124 will be released from the trigger-locking block 102 and become enabled to be pulled again to restart the firing cycle.

Figure 6:
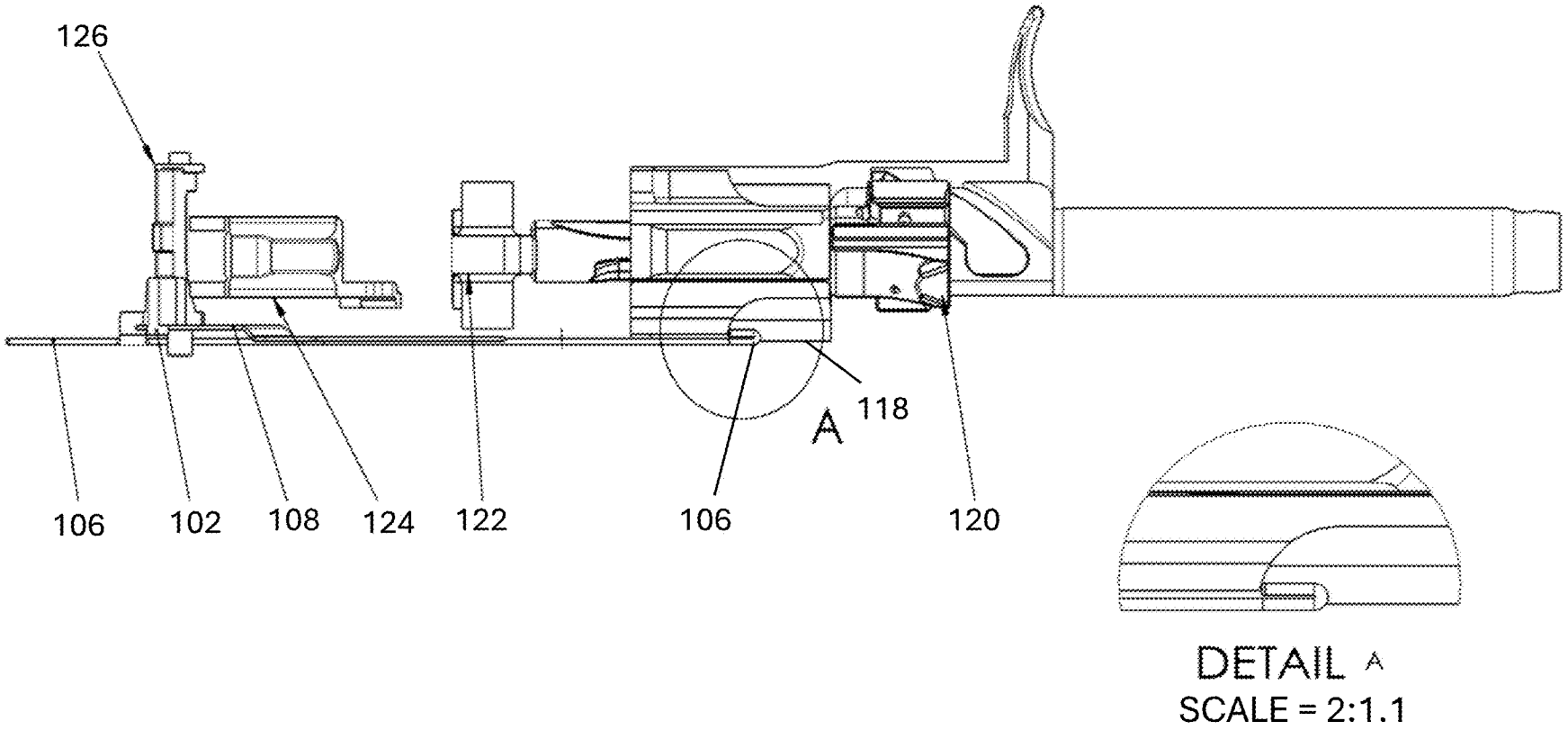
FIG. 6 illustrates a bottom view of the drop-in system for a firearms trigger, according to the example embodiment illustrated in FIG. 2.

FIG. 6 illustrates a bottom view of the drop-in system for a firearms trigger, according to the example embodiment illustrated in FIG. 2. As illustrated from a bottom view, the trigger-locking block transfer bar 106 slides along an inner side of the receiver 118 and the axis retainer plate 108 retains the trigger-locking block 102 in place with the rotational assistance of the safety axis pin 126*a*, which extends from the firearm safety 126.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A drop-in system for a semiautomatic firearm that includes a trigger assembly pivotal about a trigger axis pin, a bolt carrier that slides back and forth along a receiver of the semiautomatic firearm, a spring-loaded hammer that rotates about a hammer axis pin, a firearm safety including a corresponding safety axis pin extending therefrom, and a bolt carrier guide that extends along an interior of the receiver to guide the bolt carrier back and forth, the drop-in system comprising:

an elongated axis retainer plate having one end configured to be fixed to the hammer axis pin and a second end configured to be fixed to the safety axis pin;

a trigger-locking block configured to pivot about the firearm safety axis pin, the trigger-locking block including a limit protrusion extending from a lower end thereof to contact the elongated axis retainer plate to limit rearward pivotal movement of the trigger-locking block;

a hump block configured to pivot about the trigger pin independently of pivotal movement of the trigger assembly; and a trigger-locking block transfer bar configured to slide along the bolt carrier guide and including a limit protrusion extending from a rear bottom portion thereof.

2. The drop-in system for a semiautomatic firearm according to claim 1, wherein when the bolt carrier travels in a rearward direction along the receiver due to firing of the semiautomatic firearm:

the bolt carrier collides with the hammer;

the hammer rotates rearward and collides with the hump block;

the hump block pivots rearward and collides with the trigger assembly to rotate the trigger assembly rearward; and the bolt carrier collides with the trigger-locking block to rotate the trigger-locking block rearward to lock a rear end of the trigger assembly.

3. The drop-in system for a semiautomatic firearm according to claim 2, wherein after the bolt carrier completes the travel rearward the bolt carrier springs in a forward direction to collide with the limit protrusion of the trigger-locking block transfer bar to slide the trigger-locking bar in a forward direction such that the limit protrusion collides with a top portion of the trigger-locking block to pivot the trigger-locking block in a forward direction to release the rear end of the trigger assembly from the locked position.

4. The drop-in system for a semiautomatic firearm according to claim 3, wherein the elongated axis retainer plate comprises:

a notch formed at a first end thereof to connect with the hammer axis pin;

a hole extending through a second opposite end thereof to receive the safety axis pin therethrough; and a bend formed at a middle portion thereof to extend inward and apply a friction to a side of the trigger-locking block and to stop the limit protrusion to limit the rearward rotation of the trigger-locking block.

5. The drop-in system for a semiautomatic firearm according to claim 4, wherein the elongated axis retainer plate is disposed in the receiver by the notch formed at the first end thereof being fixed over the hammer axis pin and the safety axis pin being slid through a first hole extending through a first side of the receiver, through a hole extending through the trigger-locking block, through the hole extending through the second end of the elongated axis retainer plate, and an end of the safety axis pin being snapped into a second hole extending through a second side of the receiver.

6. A drop-in system for a semiautomatic firearm configured to be placed within a receiver of the semiautomatic firearm, comprising: an axis retainer plate configured to be disposed between a hammer axis pin and safety axis pin; a hump block configured to pivot about a trigger axis pin of a trigger to pivot the trigger backward; a trigger-locking block configured to pivot about the safety axis pin in a first direction until making contact with the elongated axis retainer plate and locking the trigger from being pulled; and a trigger-locking block transfer bar configured to slide along an inner wall of the receiver and including a limit protrusion extending from a rear bottom portion thereof to pivot the trigger-locking block in a second direction to unlock the trigger.

* * * * *